US007147679B2

(12) United States Patent
Donovan et al.

(10) Patent No.: US 7,147,679 B2
(45) **Date of Patent: *Dec. 12, 2006**

(54) SYNTHETIC FUEL PRODUCTION METHOD

(75) Inventors: Paul Donovan, Parsonsfield, ME (US); William Tis, 100 Edgecrest, Verona, PA (US) 15147

(73) Assignee: William Tis, Verona, PA (US)

( * ) Notice: Subject to any disclaimer, the term of this patent is extended or adjusted under 35 U.S.C. 154(b) by 340 days.

This patent is subject to a terminal disclaimer.

(21) Appl. No.: 10/429,343

(22) Filed: May 5, 2003

(65) Prior Publication Data

US 2004/0010968 A1 Jan. 22, 2004

Related U.S. Application Data

(63) Continuation-in-part of application No. 09/939,229, filed on Aug. 24, 2001, now Pat. No. 6,558,442.

(60) Provisional application No. 60/228,976, filed on Aug. 30, 2000.

(51) Int. Cl.
*C10L 5/00* (2006.01)

(52) U.S. Cl. ..... 44/620; 44/564; 44/579; 44/607; 44/628

(58) Field of Classification Search ..... 44/564, 44/620, 628, 573, 579, 607
See application file for complete search history.

(56) References Cited

U.S. PATENT DOCUMENTS

| | | | | |
|---|---|---|---|---|
| 4,548,615 | A * | 10/1985 | Lonchamp et al. | 44/561 |
| 6,530,966 | B1 * | 3/2003 | Kriech et al. | 44/542 |
| 6,558,442 | B1 * | 5/2003 | Donovan et al. | 44/620 |
| 6,887,282 | B1 * | 5/2005 | Giampa et al. | 44/301 |
| 2002/0050094 | A1 * | 5/2002 | Taulbee | 44/620 |

* cited by examiner

*Primary Examiner*—Cephia D. Toomer
(74) *Attorney, Agent, or Firm*—Daniel P. Cillo; Kirk D. Houser; Eckert Seamans Cherin & Mellott, LLC

(57) ABSTRACT

A method of producing a synthetic fuel by treating fines of bituminous coal with an emulsion of a tall-oil mix, which may include enhancers that either increase the chemical change in the coal or reduce the cost of the synthetic fuel. Enhancers include poly vinyl acetate (PVA) and/or ethyl vinyl acetate (EVA), glycol, lignosulfonate, beet sugar bottoms, corn bottoms, brewery bottoms, vegetable tall oil, vegetable oil, and/or spent frying oil. The emulsion is sprayed into, and reacted with, the coal fines, resulting in a cost effective and industry-usable source of synthetic fuel.

1 Claim, 7 Drawing Sheets

SYNTHETIC FUEL PRODUCTION METHOD

This application is a continuation-in-part of patent application Ser. No. 09/939,229, filed on Aug. 24, 2001 now U.S. Pat. No. 6,558,442, and claims priority under 35 U.S.C. 120 therefrom and also claims priority under 35 U.S.C. 119 from provisional application No. 60/228,976, filed Aug. 30, 2000.

BACKGROUND INFORMATION

1. Field of the Invention

This invention relates generally to the production of non-traditional fuels, often referred to as synthetic fuels. More particularly, this invention relates to the creation of such fuels using existing stockpiles of coal fines, coal dust, and other similar small particles of virgin coal. More particularly yet, this invention relates to using emulsions of tall oil and tall oil pitch, a by-product of the paper industry, in the creation of such fuels.

2. Description of the Prior Art

For centuries coal has been mined as a source of fuel. During these years, numerous improvements have been made to increase mining efficiency and safety, and to improve the overall quality and purity of the end product. However, one drawback of coal mining is the by-product of coal fines that frequently end up abandoned into waste pits scattered throughout the countryside. These coal fines constitute up to 20% of the coal being mined, and are found in the waste stream generated by the initial washing and filtering of the coal from the mine. Although coal fines include particles as small as dust motes, the term can also include pieces of coal up to about one-half inch in diameter. This material has traditionally been abandoned to waste, deposited in the form of "coal tips," because it has been economically inefficient to handle such sizes as they are brought to the point of being burned for their energy content. As a result, literally millions of tons of such material has been produced over the years, and currently lays dormant at or near mining sites. Not only does this non-use pose a great waste of valuable natural fuel resources, but it also poses a threat to the surrounding environment. In addition to respiratory hazards presented by the dust-sized particles, the large surface area associated with stockpiles of such particles poses a high risk for spontaneous combustion such as the type known as a dust explosion.

These environmental issues, together with the growing concern of the limited existing amount of natural fuel resources, has led to an increased interest in utilizing these dormant coal fines, as well as developing an alternative use of virgin coal.

Attempts to utilize coals fines as fuel include the method disclosed in White (U.S. Pat. No. 5,916,826; issued 1999), which teaches a method of pelletizing and briquetting coal fines using bio-binders produced by liquefaction of biomass. Unfortunately, this process is extremely costly, primarily because of the required liquefaction process, which is carried out in an oxygen-free environment at elevated temperatures, e.g. between 450 degrees and 700 degrees F., and elevated pressures, typically between 200 psi and 3,000 psi. The resulting liquid is then sprayed on coal fines that have themselves been heated to at least 250 degrees F., after which the coal and the liquid are allowed to react at about 300–400 degrees F. Although this method serves to alleviate certain environmental concerns, the high costs of reclaiming coal using this process undercuts the basic usefulness of the invention itself.

Another recent example of the attempt to use coal fines as fuel, Ford (U.S. Pat. No. 5,453,103; issued 1995), discloses a method of forming solid fuel pieces from coal fines by combining and mixing water, hydrochloric acid, a conditioner, and a polyvinyl acetate (PVA) emulsion and then compressing the resulting slurry into solid fuel pieces. Although this process is effective, its requirement of PVA, which must be separately created for this particular use, makes the Ford process economically and environmentally inefficient in comparison with a process founded entirely on the use of constituents that are already present, and which some of the constituents are not being devoted to any economical purpose. In other words, a process that consumed both coal fine waste and another hitherto waste element would be more desirable than the Ford process.

A process that does use as input primarily waste products from other industrial operations is revealed by Major (U.S. Pat. No. 6,013,116; issued 2000), which teaches a composition for binding coal fines into larger pieces, typically called briquets. The briquet-binder composition of Major can be produced using an asphalt base, sodium carbonate pulping liquor, and a surfactant. However, for optimal binding results, strength-increasing additives such as latex, vinyl derivatives, cellulose, cellulose derivatives, peat moss, starch, starch derivatives, and various pulps need to be added to the binder composition. (The addition of lignosulfate, cement, rubber, and plastics is also taught by Major.) Although this process does use various waste products of other industries in transforming coal fines into a more usable fuel source, the complexity of the binding material makes the process quite complex, thereby reducing the economic viability of the overall method.

An older process of reclaiming coal fines is disclosed in Dondelewski (U.S. Pat. No. 4,357,145; issued 1982). In Dondelewski, coal fines are combined with a liquid by-product of the pulp and paper industry, namely a liquid containing tall oil, tall oil pitch, or mixtures thereof ("tall oil mix"). Tall oil and tall oil pitch are by-products from the digestion of wood by the Kraft (sulfate) paper manufacturing process. In the Dondelewski method, the coal fines are first put into the form of a slurry by mixing them with water. After the slurry has been formed, it is fed to a conditioning tank where it is mixed with tall oil mix. In the conditioning tank, the tall oil mix adheres to and thus coats the surfaces of the individual coal particles, after which the slurry of now-coated coal particles and excess tall oil mix is introduced into a flotation cell, where the coated coal particles are separated from the excess tall oil mix and most of the water. Vacuum filters, vibratory screens and centrifuges may be used to remove excess liquid, a necessary step since most coal-consuming furnaces cannot tolerate a high moisture content. Again, the process of Dondelewski has as its feed stock predominantly industrial by-products, it is very process intensive, first requiring large vats to mix the coal slurry and tall oil mix, then further processing to remove excess water and tall oil mix followed by drying the end product. Thus, the method of Dondelewski does not satisfy the condition of using industrial by-products to produce a synthetic fuel that is economically competitive with the fuels that the synthetic fuel is intended to supplant, or which in general is in competition with it as a fuel source.

Therefore, what is needed is an economical and environmentally friendly method of using industrial by-products traditionally discarded as waste as the feed stock for a new fuel. What is more specifically needed, in view of the millions of tons of coal fines deposited throughout the landscape, is such a method that uses coals fines as all or part of the feed stock. Finally, what is needed is such a process that by whatever means results in a fuel that is economically viable in the marketplace, so that industries now holding hegemony over the referenced industrial by-products, and in particular the coal fines, will be induced to use up those by-products, removing them from the category of stored and hazardous waste.

BRIEF SUMMARY OF THE INVENTION

It is an object of the present invention to use fines of bituminous coal and other industrial by-products in the creation of a commercially viable fuel. Another object of the present invention is to use such hitherto waste products in a process that is environmentally friendly. A further object of the invention is to provide such a process that will reduce the overall cost of production, so as to provide industry the economic incentives to make use of the coal fines.

The term "tall oil mix" as used hereinafter shall refer to tall oil, tall oil pitch, or any combination thereof. This tall oil mix may be modified to the extent that fatty acids, rosin acids, sterols and other constituents may be added or subtracted. The term "coal fines" as used hereinafter is a collective designation for coal particles of bituminous coal, including steam or metallurgical coal fines, coal dust, and all other coal particles that can be used as feedstock for alternative fuels, as well as for coal fines, coal dust, and all other coal particles that could be used directly as a traditional fuel source, but for the fact that they are too small to be able to reach their full economic potential given the present technology. The term "tall oil emulsion" shall refer to any tall-oil-mix, suspension or solution, in water, with or without fuel enhancers.

The method of the present invention meets the invention's objectives by combining the solids of tall oil mix with coal fines, and more particularly with all or essentially all of the individual particles constituting the coal fines being processed. More particularly, the method of the present invention involves spraying tall oil emulsion into a stream of coal fines, typically an air stream of coal fines formed by letting the coal fines fall under gravity past a spray of tall oil emulsion directed substantially at right angles to the stream.

As mentioned earlier, tall oil and tall oil pitch are by-products of the digestion of wood by the Kraft (sulfate) paper manufacturing process. Tall oil is 100% organic, non-toxic and non-hazardous to handle. Based on tests carried out on behalf of the inventor, it appears that tall oil reacts chemically with the coal fines after the two components have been brought together according to the method of the present invention. The fuel produced by the present invention is a synthetic fuel in the sense of a synthetic fuel being a fuel "which does not exist in nature . . . [but rather] is synthesized or manufactured from varieties of fossil fuels which cannot be used conveniently in their original form." [*McGraw-Hill Encyclopedia of Science and Technology*, McGraw-Hill, Inc., 1982.] Moreover, it is a synthetic fuel produced by a method resulting in a significant chemical change, based upon the infra-red absorption spectra of the fuel in comparison with the infra-red absorption spectra of the fuel's constituents prior to processing.

Additionally, when tall oil is combined with coal fines it will contribute in excess of 50,000 Btu's per gallon applied, based upon a 40% solids content tall oil emulsion. It is to be emphasized here that unlike prior-art uses of tall oil, the present method is not aimed at simply producing agglomerations of the basic coal particles. Rather, it is used to produce fuel that continues to exist in small particulate form, but with the tall-oil-mix solids combined with the particulate. In carrying out this method, tall oil emulsion has numerous process advantages over the prior art methods. It can be directly sprayed into passing or free falling coal fines, therefore eliminating the necessity of having large mixing vats to coat the coal fines. Additionally, directly applying tall oil emulsion into the coal fines eliminates the need to separate the coal fines from the tall oil mixing slurry, as taught in the prior art. Elimination of these cost intensive process steps makes the processing of coal fines into a usable fuel a more economical option, and therefore provides an incentive to industry to use this fuel source. A further benefit of using tall oil emulsion is that, in contrast with the relevant prior art described above, it may be applied to the coal fines at a specific rate and specific concentration, without requiring removal of excess material with centrifuges and/or dryers. For example, the tall oil emulsion may be adjusted to contain the desired amount of tall oil to be applied to the coal fines, thus eliminating waste of valuable tall oil resources. The emulsion may be simply sprayed through various nozzles into the coal fines, either in free fall or on conveyor belts. Once sprayed, the treated coal fines need no or little drying, as the water from the emulsion evaporates as part of the process. The treated coal fines may then be sent to an agitator to further facilitate even distribution of the emulsion throughout the coal fines, and/or continue on to be agglomerated by briquetting or pelletizing apparatus. Nevertheless, it is the process of combining the coal fines with the tall-oil solids that constitutes the heart of the present invention.

Tall oil emulsions may be prepared in a variety of methods that are well known in the art. Applicants of the present invention have discovered that certain additives or "enhancers" to the tall-oil mix increase the chemical change, or reduce the cost while maintaining chemical change that takes place in the coal and enhance the fuel value of the synthetic fuel according to the present invention. For example, in an enhanced tall-oil mix, poly vinyl acetate (PVA) and/or ethyl vinyl acetate (EVA) is added as an enhancer to a tall-oil mix in an aqueous form. The solids content of the tall-oil emulsion is generally maintained at between 40 and 50% by weight, thus the amount of tall-oil mix is reduced accordingly. The use of PVA and/or EVA enhancer reduces by approximately 30% the application rate of the tall-oil mix to the coal over that of an unenhanced tall-oil mix. Other suitable materials that serve as enhancers include glycol, lignosulfonate, beet sugar bottoms, corn bottoms, brewery bottoms, vegetable tall oil, and vegetable oil or spent frying oil. Again, one or more of these materials is added to the tall-oil mix to create an enhanced tall-oil mix that reduces the cost of producing the synthetic fuel, either by allowing the use of less expensive materials while maintaining chemical change properties, or increasing the chemical change that takes place in the coal, thereby reducing the rate of application and, thus, reducing overall costs.

A further development the method of the present invention includes adding a waste material called tar decanter sludge (tds) that is a by-product of the steel industry to bituminous metallurgical coal and light cycle oil, in combination with a chemical change agent that includes PVA or EVA, a caustic solution, and the tall-oil mix, to form a synthetic fuel coke. In facilities where mechanical mixing devices are not available, these components are combined with one another via pipe systems in a dynamic manner and a homogeneous mix is accomplished via recirculation.

DETAILED DESCRIPTION OF THE INVENTION

The preferred embodiment of the invention is a method of creating a tall-oil-based emulsion 20 for spraying coal fines to effect a chemical change in the coal and to produce a synthetic fuel. Although the following description illustrates a batch system of production, an automated system can, of course, also be employed. Tall oil is heated to approximately 185° F. and piped into a mixing mill. At the same time, water containing the emulsifying agent is piped into the mill. In the Preferred Embodiment, the emulsifying agent is a nonylphenol ethoxylate surfactant with 70 moles of ethoxilation proportioned at 1% by weight of final emulsion, based upon a 100% active form of surfactant and adjusted accordingly for aqueous forms that maybe less than 100% active. For example, a 70% active form of the surfactant will require a 1.43% addition rate. The water and the emulsifying agent are heated to approximately 70° F. before entering the mixing mill. The rate at which the pitch and the surfactant and water solution are combined determines the final solids content of the emulsion, which, in the case of the Preferred Embodiment, is 40%. The mixing mill applies a shear motion on the tall oil, breaking the oil into small globules which then become suspended in the water solution. The surfactant aids the emulsification process and serves to keep the tall oil globules from coalescing with one another. The greater the shear applied, the smaller the tall oil globules formed. In general, the smaller the globules, the more stable and homogeneous is the finished tall oil emulsion. The weight of the finished tall oil emulsion 20 at 40% solids content is approximately 8.32 lbs. per gallon.

Figure 1:
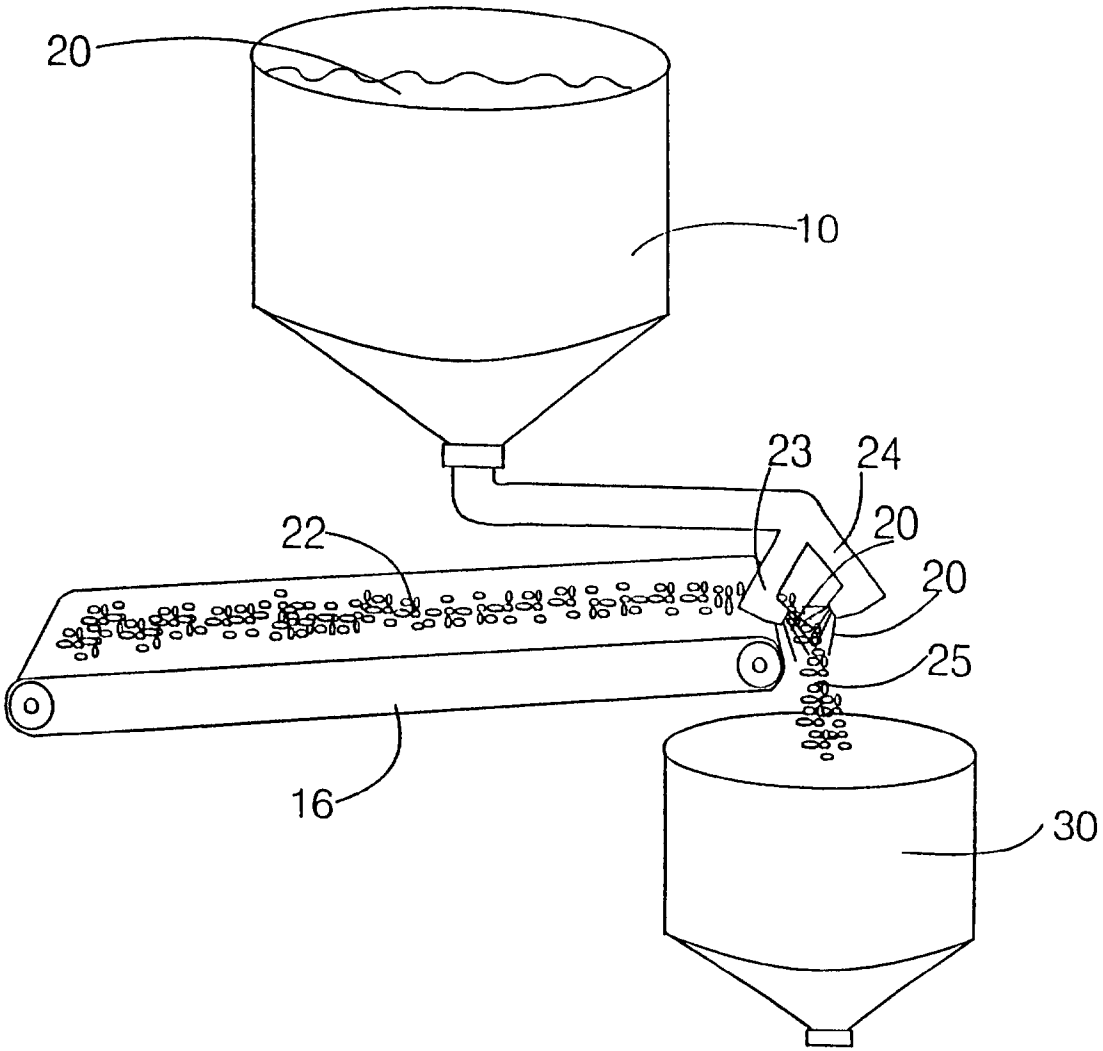
FIG. 1 is diagrammatic view of the application process in which emulsified tall oil is joined with coal fines.
Figure 2:
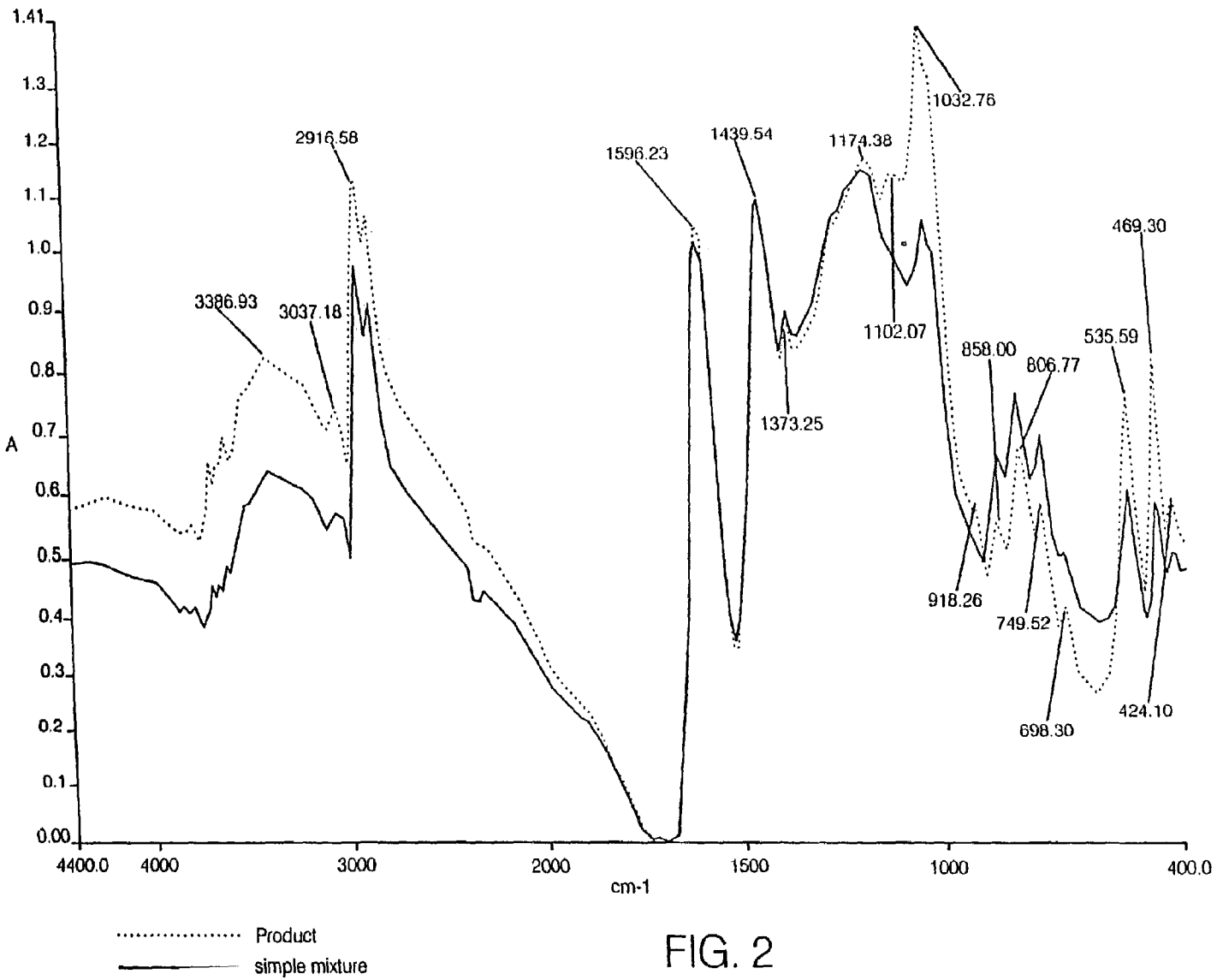
FIG. 2 is a graphical Fourier Transform Infrared (FTIR) analysis, comparing a solid synthetic fuel consisting of coal fines treated with a 40% solids tall oil emulsion at 0.5% by weight of coal versus the starting materials.
Figure 3:
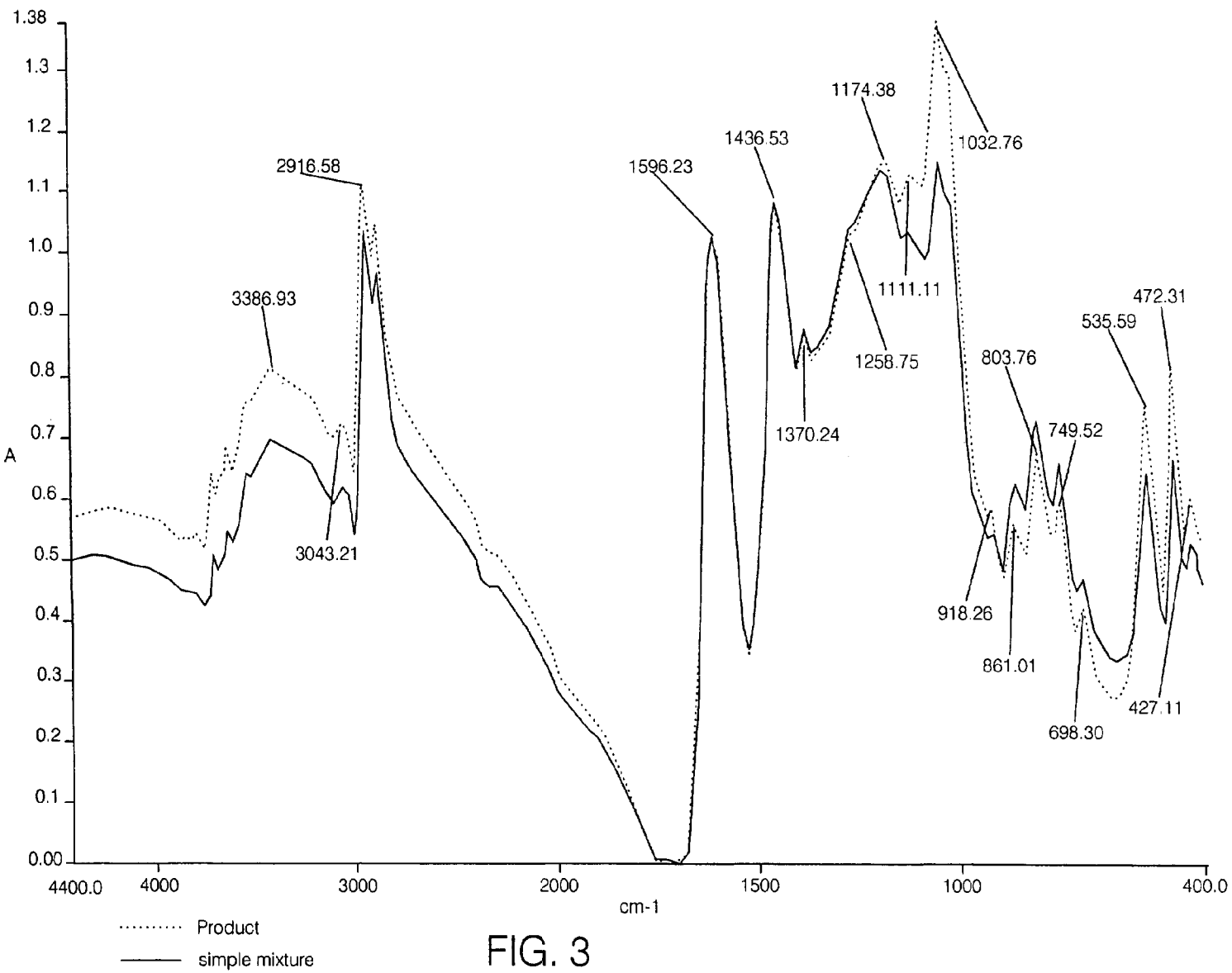
FIG. 3 is a graphical Fourier Transform Infrared (FTIR) analysis, comparing a solid synthetic fuel consisting of coal fines treated with a 40% solids tall oil emulsion at 0.75% by weight of coal versus the starting materials.
Figure 4:
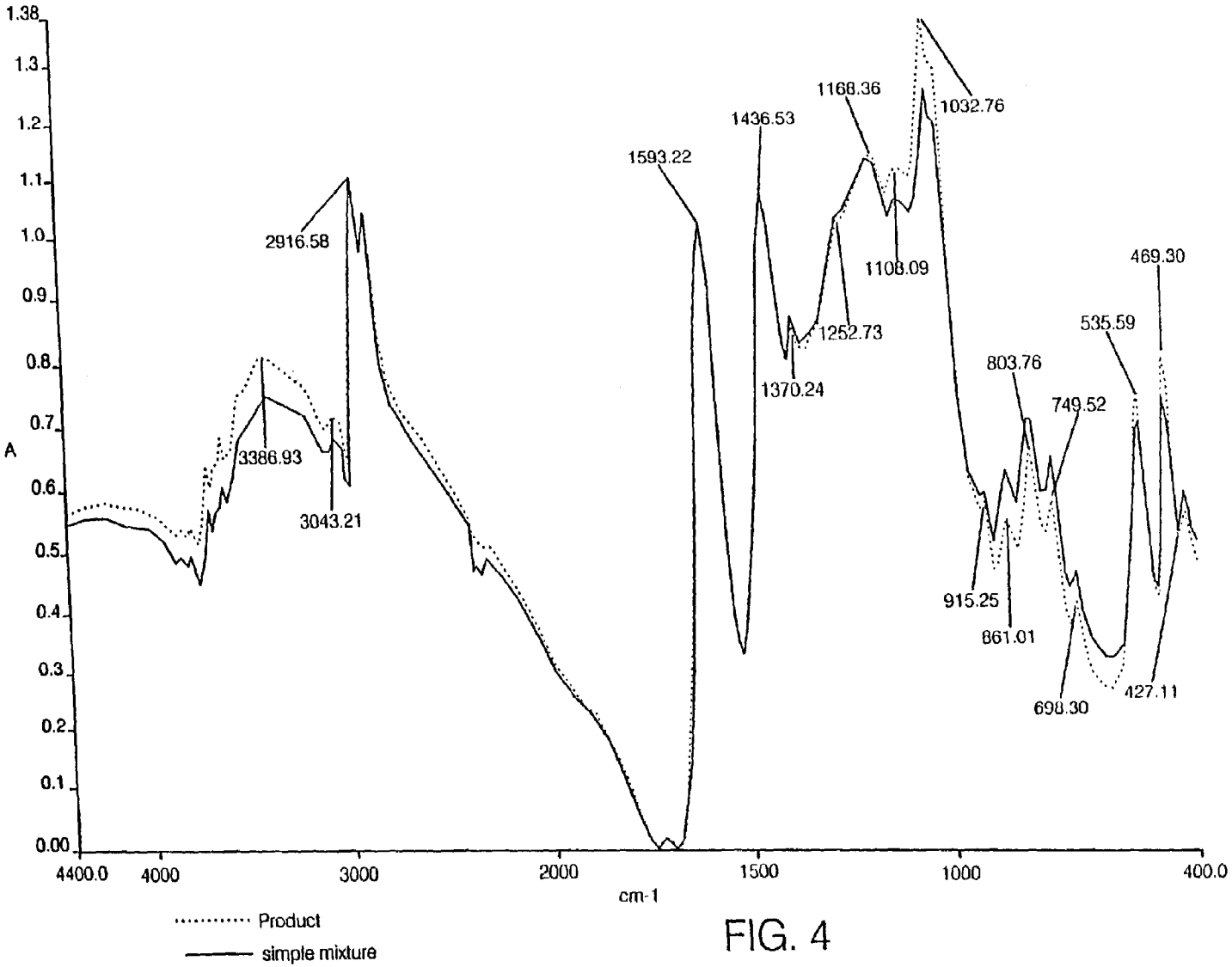
FIG. 4 is a graphical Fourier Transform Infrared (FTIR) analysis, comparing a solid synthetic fuel consisting of coal fines treated with a 40% solids tall oil emulsion at 1.0% by weight of coal versus the starting materials.
Figure 5:
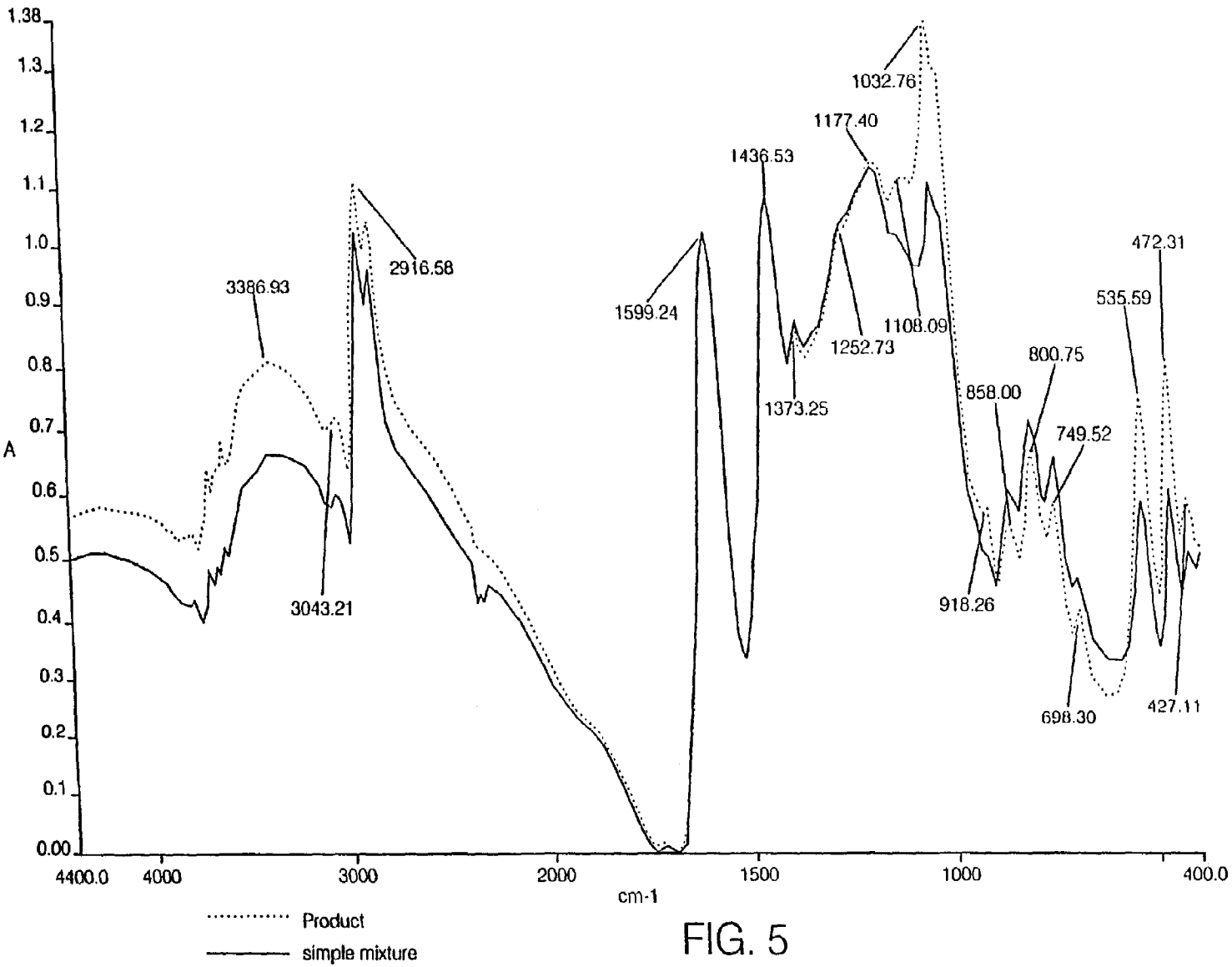
FIG. 5 is a graphical Fourier Transform Infrared (FTIR) analysis, comparing a solid synthetic fuel consisting of coal fines treated with a 40% solids tall oil emulsion at 1.25% by weight of coal versus the starting materials.
Figure 6:
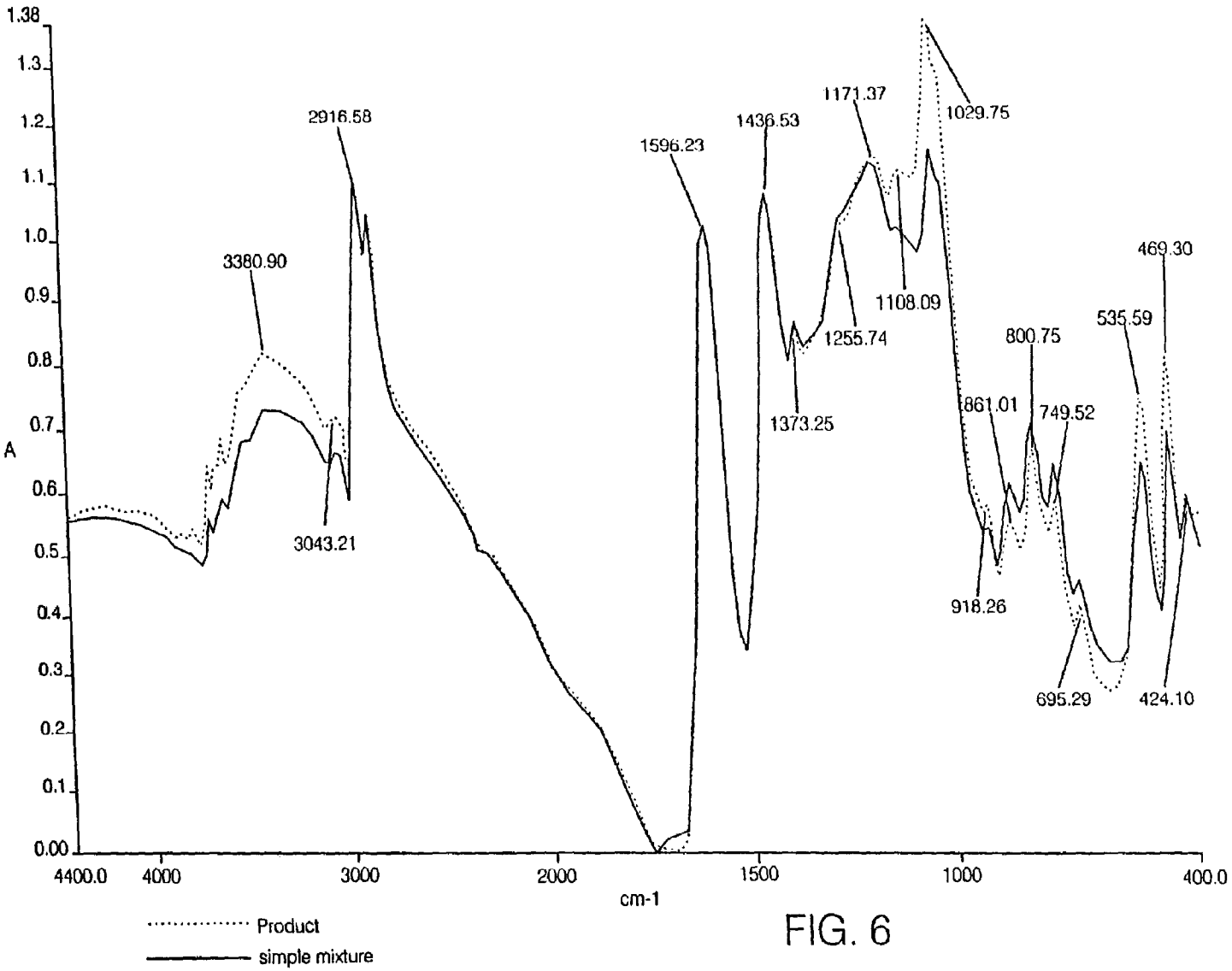
FIG. 6 is a graphical Fourier Transform Infrared (FTIR) analysis, comparing a solid synthetic fuel consisting of coal fines treated with a 40% solids tall oil emulsion at 1.5% by weight of coal versus the starting materials.

As is illustrated in FIG. 1, the tall oil emulsion 20 is nozzle-sprayed into free-falling coal fines 22 from a number of angles and sides so as to promote maximal contact with the coal fines 22. In the Preferred Embodiment, the coal fines 22 are sprayed in free fall from a conveyor 16 into a hopper 30. As shown in FIG. 1, a first spray nozzle 23 and a second spray nozzle 24 are located at a first angle and a second angle, respectively, with respect to the free-falling coal fines 22. This results in emulsion-treated coal fines 25, which are then introduced into a pug mill (not shown) to further facilitate even distribution of the emulsion throughout the coal fines 25. Thereafter, the emulsion-treated coal fines 25 (solid synthetic fuel) are conveyed to a stack-out pile (not shown), or may be agglomerated, such as pelletizing or briquetting (not shown). The use of dryers (not shown) may also be used to facilitate the evaporation of the water off the emulsion-treated coal fines 25. It is, however, a desired feature of this method to minimize the need for drying and removal of excess water by emulsifying the tall oil in advance of application. This facilitates accurate control of the amount of tall oil solids and water (tall oil emulsion 20) applied.

FIG. 2 through FIG. 6 show data taken from Fourier Transform Infrared (FTIR) analyses of samples containing varying degrees of tall oil emulsion combined with coal fines (referred to as the "product"), compared to analyses of samples of the tall oil emulsion and coal fines taken separately (referred to as "simple mixture"). The data suggest that, when coal fines are brought together with tall oil mix according to the method of the present invention, a chemical reaction takes place between the coal fines and the tall oil that results in synthetic fuel. These figures reflect amounts of tall oil emulsion (at 40% solids) added from 0.5% to 1.5% by weight of coal, as seen in Tables 1–5 shown in parent patent U.S. 6,558,442B2. The non-destructive FTIR analyses are able to explore coal's functional group content of the coal. "Functional group" refers to chemical species bonded to aromatic carbon ring structure sites where chemical reactions commonly take place. This analytical technique identifies molecular vibrations due to the absorption of infrared radiation by functional groups with characteristic absorption bands. Such testing is able to ascertain the presence of significant chemical changes in a sample of the coal fines treated with the tall-oil emulsion, in comparison with un-treated coal fines.

In order to obtain the spectra shown in FIG. 2 through FIG. 6, the samples were imbedded in potassium bromide pellets, and light in the infrared range of 400–4000 $cm^{-1}$ was passed through the pellets. The chemical bonds present determine the absorption spectrum. For example, typically triple bonds and hydrogen stretching are represented by a spectral region of 4000 $cm^{-1}$ to approximately 1800 $cm^{-1}$. Double bonded structures and aromatic structures have an FTIR range of approximately 1800 $cm^{-1}$ to 1400 $cm^{-1}$. Single bond structures consisting of various aromatic substitution bonding have an FTIR range from 1000–400 $cm^{-1}$. Supporting Fourier Transform Infrared (FTIR) data from other laboratories not using potassium bromide pellets and preparing samples with other methodology yield similar results.

Separate scans of the samples were done and the baselines adjusted for accuracy in the context of comparing the base materials and the manufactured fuel product, and the results can be seen in FIG. 2 through FIG. 6. The differences in peak absorption is a strong indication that the coal fines do in fact react with the tall oil emulsion.

In a further embodiment of the tall-oil mix described above, an enhanced tall-oil mix is produced by adding an enhancer to the tall-oil mix in a ratio of about approximately 10% enchancer to approximately 90% tall-oil. Suitable enhancers include such substances as poly vinyl acetate (PVA) and/or ethyl vinyl acetate (EVA), glycol, lignosulfonate, beet sugar bottoms, corn bottoms, brewery bottoms, vegetable tall oil, vegetable oil, and/or spent frying oil. One or more of these enhancers may be added to the finished tall-oil mix (emulsion), to the tall-oil or tall-oil pitch before emulsion, or applied simultaneously with the tall-oil emulsion to the coal fines. In an enhanced tall-oil mix using vegetable oil or spent frying oil, the oil is combined with tall-oil pitch in a ratio of 1 part vegetable oil or spent frying oil to 3 parts tall-oil pitch.

A further development of the synthetic fuel according to the method of the present invention includes a synthetic fuel coke that is produced by adding tar decanter sludge that is a by-product of the steel industry to bituminous metallurgical coal and light cycle oil, in combination with a chemical change agent that includes PVA or EVA, a caustic solution, and a tall-oil mix, to form a synthetic fuel coke 30. For example, a 90:10 enhanced tall-oil mix 31 comprising 90% tall-oil mix emulsion and 10% of a PVA or EVA emulsion for a total weight addition rate of 0.85% is combined in a weight addition rate of 0.27% of a combination of tar decanter sludge and light cycle oil, 0.08% of 20% caustic solution; and 0.26% water with bituminous metallurgical coal to produce the synthetic fuel coke 30. This emulsion is mixed with the coal via re-circulation or mechanical mixing.

Figure 7:
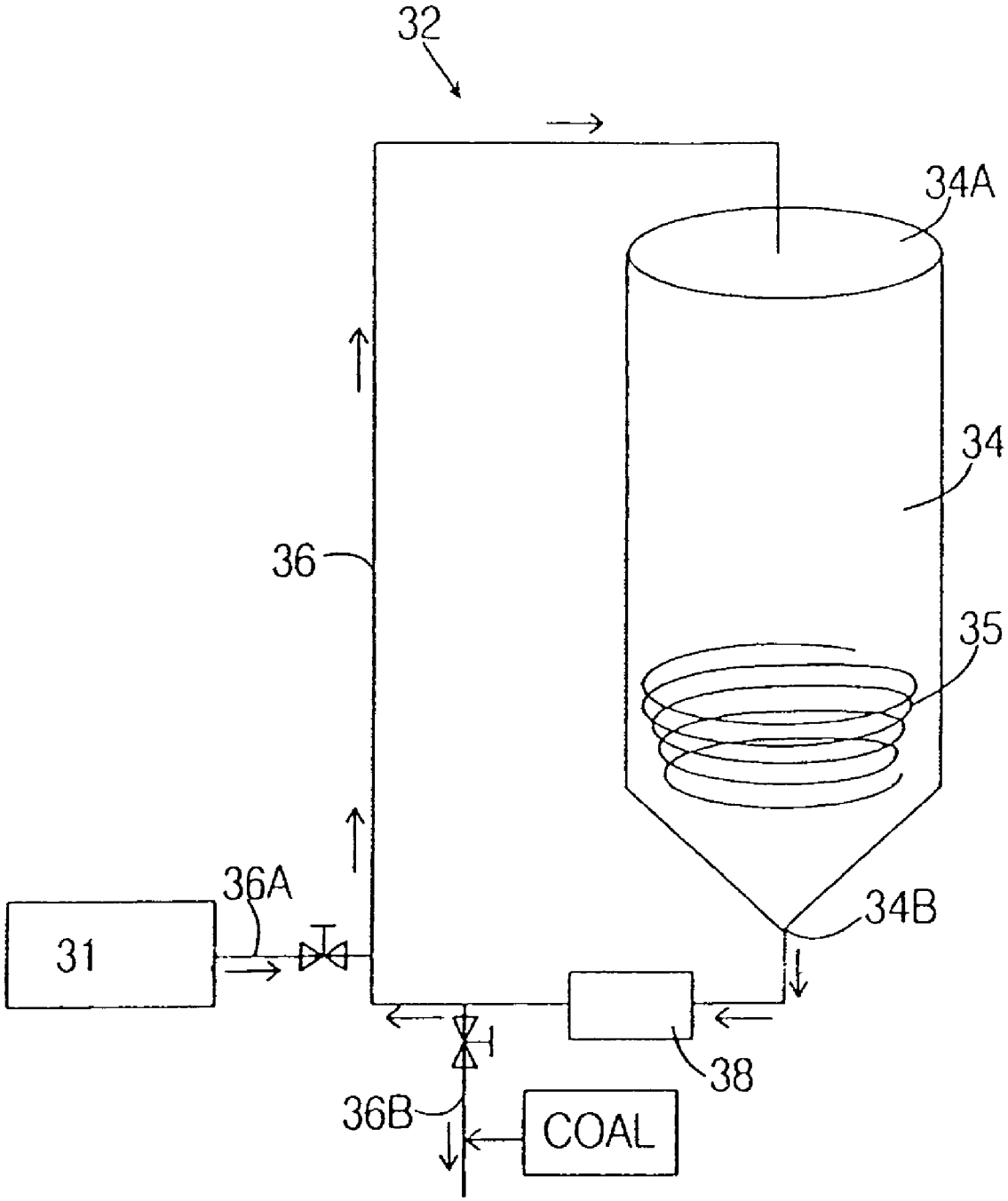
FIG. 7 is a schematic illustration of apparatus for preparing the synthetic fuel coke according to the method of the invention.

FIG. 7 illustrates apparatus 32 for mixing by re-circulation of enhanced tall-oil mix the tar decanter sludge and light cycle oil, the caustic solution and water with the bituminous metallurgical coal. The apparatus 32 includes a tank 34 having a tank inlet 34A and a tank outlet 34B, and a recirculating line 36 with an inlet 36A for enhanced tall-oil mix and caustic solution and an outlet 36B for discharging the synthetic fuel coke 30 As shown, heating means 35 are included within the tank 34. The tar decanter sludge and light cycle oil are heated in the tank 34. The enhanced tall-oil mix, the caustic solution, and water are introduced into the recirculating line 36 and fed into the tank 34, where all materials are mixed and, if necessary, passed through a orinding pump 38 before being discharged from the recirculating line 36 as synthetic fuel coke 30. This is merely an example of apparatus for mixing an enhanced tall-oil mix, tar decanter sludge and light cycle oil, caustic solution, and water with an emulsion to produce synthetic fuel coke. It shall be understood that variations of the formulation are included within the scope of the invention.

The details that have been provided here regarding the Preferred Embodiment of the present invention are by way of example only and are in no way intended to limit the scope of the claimed invention.

What is claimed is:

1. A method of producing a synthetic fuel coke, said method comprising the steps of:

(a) preparing an enhanced tall-oil mix that includes an enhancer;

(b) preparing an emulsion by mixing said tall-oil mix, a caustic solution, and water, and (c) combining said emulsion with tar decanter sludge and bituminous metallurgical coal so as to obtain said synthetic fuel coke;

wherein the enhancer reduces by approximately 30% an application rate of the tall-oil mix to the coal over that of an unenhanced tall-oil mix.

* * * * *

UNITED STATES PATENT AND TRADEMARK OFFICE

CERTIFICATE OF CORRECTION

PATENT NO. : 7,147,679 B2
APPLICATION NO. : 10/429343
DATED : December 12, 2006
INVENTOR(S) : Paul Donovan and William Tis It is certified that error appears in the above-identified patent and that said Letters Patent is hereby corrected as shown below:

Column 7, line 24, “mix the” should be --mix, the--.

Column 7, line 30, “fuel coke 30 As” should be --fuel coke 30. As--.

Column 8, line 5, “orinding” should be --grinding--.

Signed and Sealed this

Eighth Day of April, 2008

JON W. DUDAS
*Director of the United States Patent and Trademark Office*